US010377142B2

(12) United States Patent
Chen et al.

(10) Patent No.: US 10,377,142 B2
(45) **Date of Patent: *Aug. 13, 2019**

(54) OVERMOLDED INK DELIVERY DEVICE

(71) Applicant: HEWLETT-PACKARD DEVELOPMENT COMPANY, L.P., Houston, TX (US)

(72) Inventors: Chien-Hua Chen, Corvallis, OR (US); Michael W. Cumbie, Albany, OR (US); Devin Alexander Mourey, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/988,206

(22) Filed: May 24, 2018

(65) Prior Publication Data

US 2018/0264834 A1 Sep. 20, 2018

Related U.S. Application Data

(63) Continuation of application No. 15/304,767, filed as application No. PCT/US2014/035345 on Apr. 24, 2014, now Pat. No. 10,016,983.

(51) Int. Cl.

| | |
|---|---|
| ***B41J 2/175*** | (2006.01) |
| ***B41J 2/16*** | (2006.01) |
| *B41J 2/14* | (2006.01) |

(52) U.S. Cl.

CPC ..... *B41J 2/17553* (2013.01); *B41J 2/1601* (2013.01); *B41J 2/1623* (2013.01); (Continued)

(58) Field of Classification Search

CPC ..... B41J 2/17553; B41J 2/17513; B41J 2/17559; B41J 2/1601; B41J 2/1623; B41J 2/14145; B41J 2002/14362

See application file for complete search history.

(56) References Cited

U.S. PATENT DOCUMENTS 6,227,651 B1 5/2001 Watts et al.
6,328,423 B1 * 12/2001 Wong ..... B41J 2/14024 347/49

(Continued)

FOREIGN PATENT DOCUMENTS

CN 1297815 A 6/2001
CN 1972998 5/2007

(Continued)

OTHER PUBLICATIONS

Zaal; "Design for Reliability of Water Level MEMS Packaging"; Oct. 29, 2012; pp. 1-128.

*Primary Examiner* — Yaovi M Ameh

(74) *Attorney, Agent, or Firm* — HP Inc. Patent Department

(57) ABSTRACT

An ink delivery device is described. The ink delivery device includes an ink die with a first surface. The ink delivery device also includes an overmold to encapsulate a number of surfaces of the ink die. The overmold has a second surface that is wider than the first surface. The second surface receives an adhesive to attach the ink delivery device to a printhead. The ink delivery device also includes an ink slot passing through the overmold and at least a portion of the ink die.

18 Claims, 7 Drawing Sheets

(52) U.S. Cl.
CPC ..... *B41J 2/17513* (2013.01); *B41J 2/17559* (2013.01); *B41J 2/14145* (2013.01); *B41J 2002/14362* (2013.01)

(56) References Cited

U.S. PATENT DOCUMENTS

| | | | | |
|---|---|---|---|---|
| 6,336,700 | B1 | 1/2002 | Hays | |
| 6,548,895 | B1 | 4/2003 | Benavides et al. | |
| 8,382,253 | B1 | 2/2013 | Rivas et al. | |
| 8,541,260 | B1 | 9/2013 | Darveaux et al. | |
| 9,676,189 | B2 | 6/2017 | Chng | |
| 2004/0067446 | A1 | 4/2004 | Hall et al. | |
| 2004/0100522 | A1 | 5/2004 | Horvath | |
| 2005/0024450 | A1 | 2/2005 | Seu | |
| 2005/0162463 | A1 | 7/2005 | Silverbrook et al. | |
| 2006/0001704 | A1* | 1/2006 | Anderson | B41J 2/17513 347/65 |
| 2007/0139470 | A1 | 6/2007 | Lee | |
| 2008/0266369 | A1 | 10/2008 | Petersen | |
| 2009/0058921 | A1* | 3/2009 | Habashi | B41J 2/16585 347/29 |
| 2009/0143511 | A1 | 6/2009 | Ikezawa | |
| 2009/0221114 | A1 | 9/2009 | Xu | |
| 2010/0001410 | A1 | 1/2010 | Kang | |
| 2010/0013889 | A1 | 1/2010 | Yamanaka et al. | |
| 2010/0156989 | A1 | 6/2010 | Petruchik | |
| 2011/0037808 | A1 | 2/2011 | Ciminelli | |

FOREIGN PATENT DOCUMENTS

| | | |
|---|---|---|
| CN | 101563231 | 10/2009 |
| CN | 101668696 | 3/2010 |
| CN | 102470672 A | 5/2012 |
| CN | 103442894 | 12/2013 |
| JP | S60-262649 | 12/1985 |
| JP | H06-155764 | 6/1994 |
| JP | 2008-143132 | 6/2008 |
| JP | 2008-290332 | 12/2008 |
| JP | 2012-512768 | 6/2012 |
| WO | WO-2006004888 | 1/2006 |
| WO | WO-2015041665 | 3/2016 |

* cited by examiner

OVERMOLDED INK DELIVERY DEVICE

BACKGROUND

Printers are devices that deposit ink on a print medium. A printer may include a printhead that includes an ink reservoir. The ink is expelled from the printhead onto a print medium via an ink ejection device.

BRIEF DESCRIPTION OF THE DRAWINGS

The accompanying drawings illustrate various examples of the principles described herein and are a part of the specification. The illustrated examples do not limit the scope of the claims.

Throughout the drawings, identical reference numbers designate similar, but not necessarily identical, elements.

DETAILED DESCRIPTION

Figure 1:
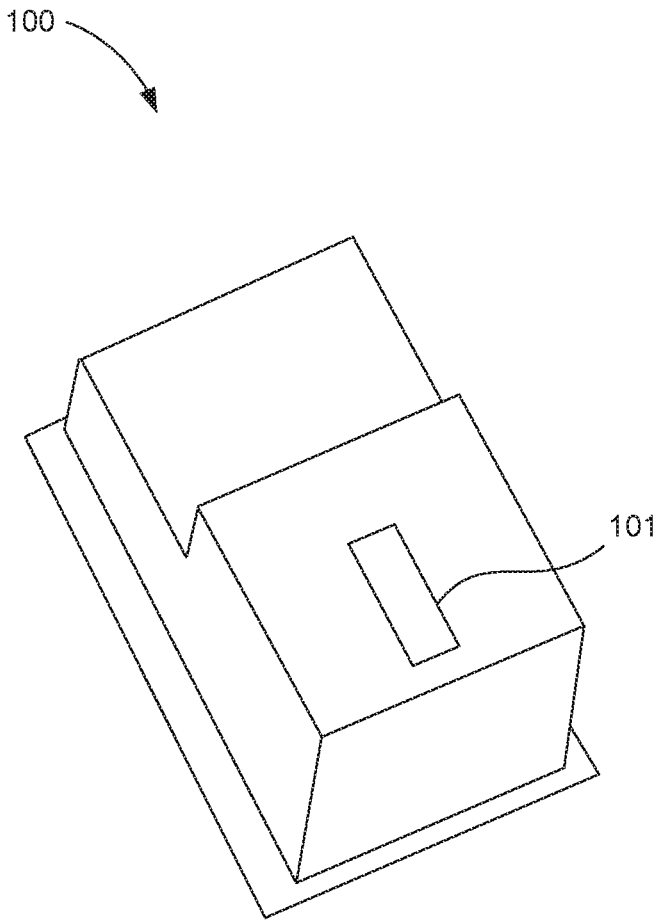
FIG. 1 is a diagram of a printhead that uses an overmolded ink delivery device according to one example of the principles described herein.

Printers are used to deposit ink on a print medium. Accordingly, a printer may include a printhead that includes an ink reservoir fluidly connected to an ink ejection device. An ink ejection device may include a nozzle through which the ink is distributed onto a print medium, a firing chamber that holds a small amount of ink, and a device for ejecting the ink out of the firing chamber and through the nozzle. Ink may be delivered from the ink reservoir to the firing chamber and nozzle via an ink delivery device. The ink delivery device may include an ink die. A slot cut in the ink die may serve as a channel to direct the ink to the ink ejection device at an appropriate rate. The rate at which the ink is delivered to the ink ejection device may be based on a width and pitch of the ink slot. However, while ink delivery devices may be useful in moving ink in a printing operation, the continued development of printers and user-demand may render current ink delivery devices inefficient.

For example, as printheads develop, the space available on a printhead may be at a premium and it may be desirable to reduce the size of ink delivery components such as ink dies and ink delivery devices. However, current ink delivery devices may be constrained on how small they can be produced. More specifically, an ink die is attached to a printhead via an adhesive. If an ink die is too small, the adhesive may cover a portion of the ink slot, thereby reducing the ability of the ink delivery device to move ink to the ejection device for deposition on a print medium. A smaller amount of adhesive may not be possible as a smaller amount of adhesive may not have enough holding strength to maintain the ink delivery device to the printhead.

Additionally, a further reduction in size of an ink delivery device may give rise to corresponding reduction in size of components of the printhead. Such a reduction in size of the printhead components may be complex and may give rise to additional manufacturing processes. Such complexity and additional manufacturing processes may make such reduction impractical.

Accordingly, the systems and methods disclosed herein allow for a simple and cost-effective ink delivery device that is not constrained by the aforementioned limitations. More specifically, the present disclosure describes an overmolded ink delivery device that incorporates an encapsulated ink die with an ink slot disposed in the ink die. The overmold may allow the ink die to be further reduced in size without corresponding changes being made to the traditional ink printhead. Furthermore, the overmold may provide adequate spacing between the ink dies such that printing functionality may be maintained. In other words, the overmolded ink delivery device as described herein allows for an ink die to be sized independently of the constraints mentioned above with regards to the adhesive pad and proximity of adjacent dies. That is, the limitations preventing current ink dies from being further reduced in size are removed such that an ink die may be smaller than presently possible.

The present disclosure describes an ink delivery device. The device may include an ink die with a first surface. The device may also include an overmold to encapsulate a number of surfaces of the ink die. The overmold may include a second surface that is wider than the first surface. The second surface receives an adhesive to attach the ink delivery device to a printhead. The device may also include an ink slot passing through the overmold and at least a portion of the ink die.

The present disclosure describes an ink delivery system. The system may include a printhead that includes an ink reservoir. The system may also include a number of ink delivery devices. Each ink delivery device may include an ink die with a first surface. Each ink delivery device may also include an overmold to encapsulate a number of surfaces of the ink die. The overmold may include a second surface that provides a larger contact area than the first surface. Each ink delivery device may also include an ink slot passing through the overmold and at least a portion of the ink die. The system may also include an adhesive disposed between the printhead and the second surface to attach the ink delivery device to the printhead.

The present disclosure describes a method of manufacturing an ink delivery device. The method may include placing an ink die with a first surface on a carrier substrate. The method may also include encapsulating a number of surfaces of the ink die with an overmold having a second surface. The second surface may be used to attach the ink delivery device to a printhead and may be wider than the first surface. The method may further include forming an ink slot through the second surface and the first surface.

As used in the present specification and in the appended claims, the term "ink ejection device" or similar language may refer to a number of components used to eject ink on to a print medium. For example, an ink ejection device may include a resistor, a firing chamber, and a nozzle, among other ink ejection components.

Still further, as used in the present specification and in the appended claims, the term "contact area" may refer to a space available for attaching the ink delivery device to a printhead.

As used in the present specification and in the appended claims, the term "a number of" or similar language may include any positive number including 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described is included in at least that one example, but not necessarily in other examples.

Turning now to the figures, FIG. 1 is a diagram of a printhead (100) that uses an overmolded ink delivery device (101) according to one example of the principles described herein. In some examples, the printhead (100) may carry out at least a part of the functionality of ejecting ink droplets on to a print medium. For example, the printhead (100) may include an ink reservoir that holds ink to be deposited on a print medium. The printhead (100) may eject drops of ink from nozzles onto a print medium in accordance with a received print job. The printhead (100) may also include other circuitry to carry out various functions related to printing. In some examples, the printhead (100) may be removable from the printing system for example, as a disposable printer cartridge. In some examples, the printhead (100) may be part of a larger system such as an integrated printhead (IPH). The printhead (100) may of varying types. For example, the printhead (100) may be a thermal inkjet (TIJ) printhead.

The printhead (100) may include a number of overmolded ink delivery devices (101). An overmolded ink delivery device (101) may be any component, or combination of components used to eject ink from the printhead (100). For example, the overmolded ink delivery device (101) may be coupled to an ink ejection device, the ink ejection device including a firing chamber, a resistor, and a number of nozzles, among other ink ejection components. A nozzle may be a component that includes a small opening through which ink is deposited onto the print medium. The firing chamber may include a small amount of ink. The resistor may be a component that heats up in response to an applied voltage. As the resistor heats up, a portion of the ink in the firing chamber vaporizes to form a bubble. This bubble pushes liquid ink out the nozzle and onto the print medium. As the vaporized ink bubble pops, a vacuum pressure within the firing chamber draws ink into the firing chamber from the ink reservoir, and the process repeats. As will be described in detail below, the overmolded ink delivery device (101) may include a slot for delivering ink from an ink reservoir to the firing chamber. While FIG. 1 depicts a single overmolded ink delivery device (101), a printhead (100) may include any number of overmolded ink delivery devices (101), and FIG. 1 depicts a single overmolded ink delivery device (101) for simplicity.

An overmolded ink delivery device (101) may be beneficial in that it allows for an ink die within the ink delivery device (101) to be further reduced in size as compared to the printhead (100). The reduced footprint of the overmolded ink delivery device (101) may free up space on the printhead (100) to be used for other components, circuitry, or combinations thereof. Moreover, the overmold around the ink die may provide additional die strength which may reduce ink die breakage rates. The overmold may also allow a smaller ink die to be backwards compatible with a number of different sizes, and shapes of printhead (100).

Figure 2A:
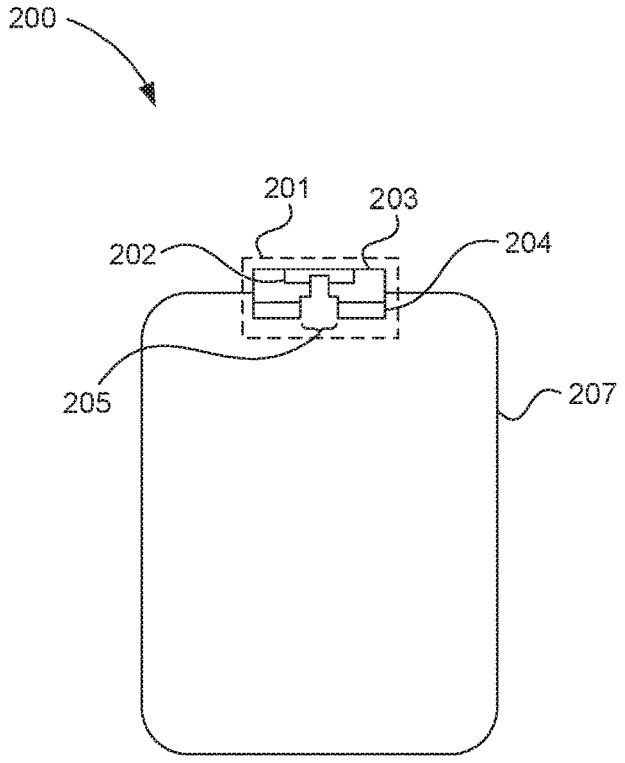
FIG. 2A is a cross sectional diagram of a printhead that uses an overmolded ink delivery device according to one example of the principles described herein.
Figure 2B:
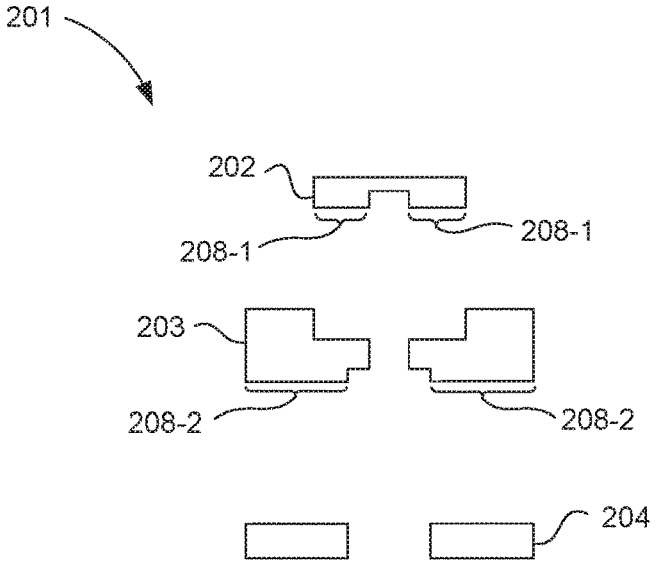
FIG. 2B is an exploded cross sectional diagram of an overmolded ink delivery device according to one example of the principles described herein.

FIGS. 2A and 2B are cross sectional diagram of a printhead (200) that uses an overmolded ink delivery device (201) according to one example of the principles described herein. In some examples, the printhead (200) may include an ink reservoir (207) that contains ink to be deposited on a print medium. In some examples, the printhead (200) may include a number of ink reservoirs (207). For example, the printhead (200) may include a number of different ink reservoirs (207) that correspond to different colors of ink to be deposited on the print medium.

The printhead (200) may also include a number of ink delivery devices (201). An ink delivery device (201) is indicated by the dashed line in FIG. 2A. FIG. 2B is an exploded cross sectional diagram of an overmolded ink delivery device (201) according to one example of the principles described herein. The ink delivery device (201) may include an ink die (202) having a first surface (208-1). The first surface (208-1) may be a surface that is in contact with the overmold (203). In some examples, the first surface (208-1) is not in contact with the printhead (200) or the adhesive (204). The ink die (202) may serve as a substrate in which an ink slot (205) is formed. The ink slot (205) may be used to deliver ink from the ink reservoir (207) to the ink ejection device which may include a firing chamber, nozzle, and a resistor, among other ink ejection components. The ink die (202) may be made of any number of materials. For example, the ink die (202) may be made out of silicon.

As described below, the ink delivery device (201) may include an overmold (203) that encapsulates the ink die (202). The overmold (203) may include a second surface (208-2) that is used to attach the ink delivery device (201) to the printhead (200) via an adhesive (204). The second surface (208-2) may be wider than the first surface (208-1). As described above, in some examples, the ink die (202) may not be in contact with the adhesive (204). In these examples, the overmold (203), via the second surface (208-2), may exclusively provide for attachment of the ink delivery device (201) to the printhead (200).

As demonstrated above, the overmold (203) may provide a larger contact area (i.e., the second surface (208-2)) than would otherwise be possible (i.e., the first surface (208-1)). For example, without an overmold (203) with an increased second surface (208-2), an ink die (202) may rely on the smaller first surface (208-1) to attach the ink die (202) to the printhead (200). Relying on just the first surface (208-1) of the ink die (202) may 1) not provide sufficient adhesion to the printhead (200) and 2) may constrain the size of the ink die (202) as too small an ink die (202) may lead to printing malfunctions. Thus, the larger size second surface (208-2) of the overmold (203) may be beneficial by increasing the adherence of the ink delivery device (201) as compared to what would otherwise be possible relying on just the first surface (208-1) of the ink die (202).

Accordingly, the ink die (202) may be reduced to a size smaller than would otherwise be possible while still being able to be properly attached to the printhead (201). For example, the ink die (202) may be less than 1000 micrometers wide. In this example, the overmold (203) may be sufficiently wide to adhere, via the adhesive (204) to the printhead (200).

Additionally, the overmold (203) may encapsulate a number of other surfaces of the ink die (202). For example, as depicted in FIG. 2, the overmold (203) may surround the ink die (202) on a right surface and on a left surface. Encapsulating a right surface and a left surface of the ink die (202) may be beneficial in that it supports the ink die (202) and protects the ink die (202) from damage. The overmold (203) may have a surface that may be flush with a surface of the ink die (202).

In some examples, the overmold (203) may be an epoxy molding compound (EMC). The epoxy molding compound may add structural stability to the ink delivery device (201) such that the smaller ink die (202) may be more robust. The overmold (203) may also protect the ink die (202) from breakage. The EMC overmold (203) may include a number of fillers such as silica powder, alumina, silicon nitride, manganese oxide, calcium carbonate, titanium white, or combinations thereof. A process for coating the ink die (202) with the overmold (203) is described below in connection with FIGS. 6A and 6B.

An overmold (203) that encapsulates the ink die (202) may be beneficial in that it allows an ink die (202) to be further reduced in size regardless of any limitations imposed by the printhead (200). For example, for an ink die (202) to be attached to a printhead (200), a particular contact area may be used to facilitate adhesive (204) attachment. In this example, the desired contact area may be provided by the overmold (203), such that the ink die (202) may be further reduced in size.

Using the overmold (203) to attach the ink die (202) to the printhead (200) may also be beneficial in that it increases a separation between the adhesive (204) and the ink die (202), such that the adhesive (204) may not interfere with the printing operation of the ink die (202). More specifically, as indicated in FIG. 2A, in some examples, the ink die (202), on account of the overmold (203), may not be in contact with the printhead (200). Still further, the ink die (202), on account of the overmold (203), may not be in contact with the adhesive (204) used to attach the ink delivery device (201) to the printhead (200). In other words, the attachment of the ink delivery device (201) to the printhead (200) may be provided exclusively by the adhesive (204) placed on the overmold (203). Moreover, the overmold (203) may allow the reduced-size ink die (202) to be incorporated into the printhead (200) without modification to the printhead (200).

The ink delivery device (201) may also include an ink slot (205) passing through the overmold (203) and at least a portion of the ink die (202). For example, the ink slot (205) may pass through the second surface (208-2) and at least a portion of the first surface (208-1).

The ink slot (205) may be a channel through which ink travels from the ink reservoir (207) to an ink ejection device which may include a resistor, a firing chamber, and a nozzle. For simplicity, FIGS. 2A and 2B, and the other figures in this disclosure, indicate a single ink slot (205), however, any number of ink slots (205) may be used in conjunction with the ink delivery device (201). In one example, the ink slot (205) may run along a length of the ink die (202). For example, the ink slot (205) may run perpendicular to the cross-sectional diagram indicated in FIG. 2A. As will be described in connection with FIGS. 9 and 10, the ink slot (205) may be a partial ink slot (205) or a through ink slot (205). In a partial ink slot (205), the void may extend through the overmold (203) and into a portion of the ink die (202). In a through ink slot (205), the void may extend through the overmold (203) and through the ink die (202).

In some examples, the ink delivery device (201) may include an adhesive (204) disposed between the printhead (200) and the second surface (208-2) to attach the ink delivery device (201) to the printhead (200). In some examples, the adhesive (204) may not be in contact with the first surface (208-1) of the ink die (202), which may facilitate proper printing operation.

In some examples, the adhesive (204) may be the same width as the overmold (203). As described above, in some examples, the ink die (202) may be smaller than the adhesive (204). This may allow the ink die (202) to be sized without limitation imposed by the contact area for attaching to the adhesive (204).

The ink delivery device (201) depicted in FIG. 2 may be beneficial in that it allows for smaller ink dies (202) to be positioned on a printhead (200) while avoiding the complications associated with small ink dies (202). For example, the overmolded ink delivery device (201) may allow for sufficient ink die (202) separation and a sufficient ink slot (205) pitch. Moreover, the overmold (203) may decouple an ink die (202) size from a size of an adhesive used to adhere the ink die (202) to the printhead (200).

Figure 3:
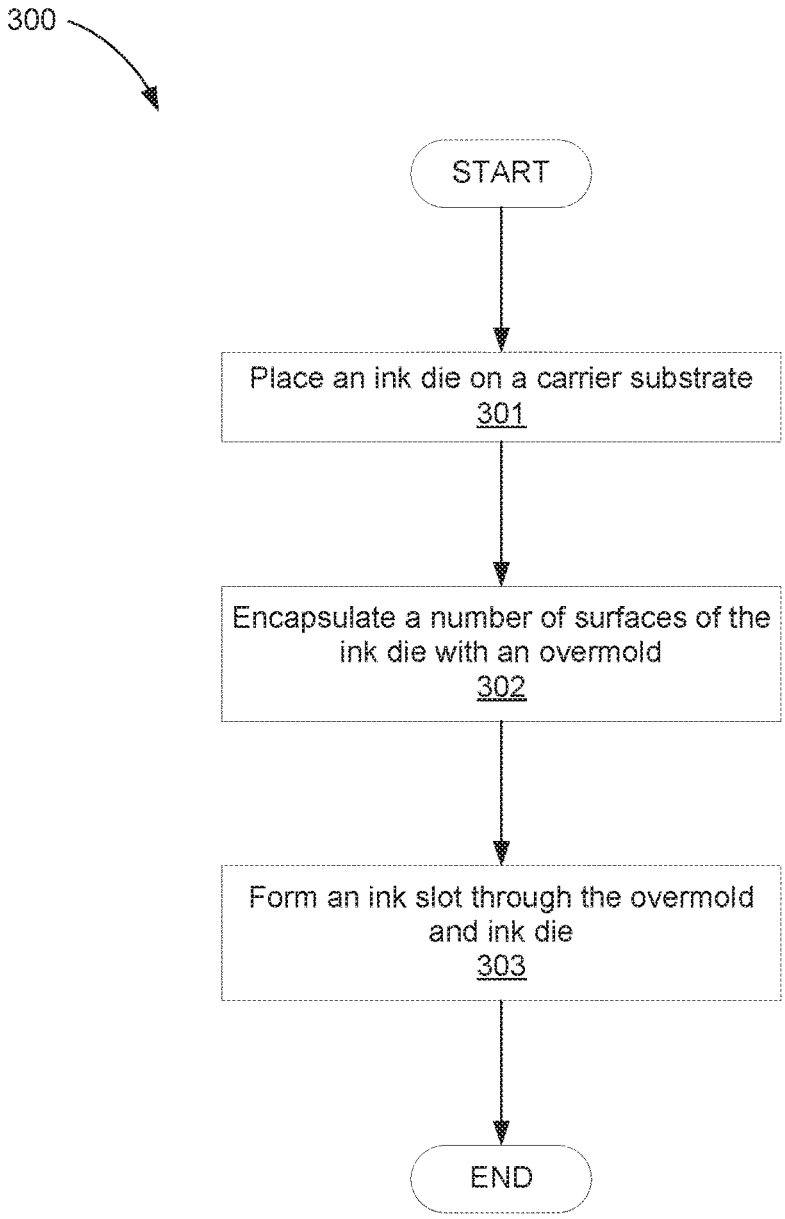
FIG. 3 is a flowchart of a method for forming an overmolded ink delivery device according to one example of the principles described herein.

FIG. 3 is a flowchart of a method (300) for forming an overmolded ink delivery device (FIG. 1, 101) according to one example of the principles described herein. The method (300) may include placing (block 301) an ink die (FIG. 2, 202) with a first surface on a carrier substrate. As described above, the ink die (FIG. 2, 202) may be formed from a silicon substrate. In this example, a number of ink dies (FIG. 2, 202) may be formed on a sheet of silicon substrate. In one example, the ink dies (FIG. 2, 202) may be mechanically cut from a sheet of silicon substrate. In another example, the ink dies (FIG. 2, 202) may be stealth diced. Stealth dicing may refer to a process wherein a laser, such as an infrared laser, may create microcracks on the silicon substrate in the form of the individual ink dies (FIG. 2, 202). The individual ink dies (FIG. 2, 202) may then be snapped or broken to be separated. The separated ink dies (FIG. 2, 202) may be placed on a dicing tape. The dicing tape may be expanded such that the ink dies (FIG. 2, 202) are spaced as desired. The ink dies (FIG. 2, 202) may then be placed (block 301) on a carrier substrate. For example, the dicing tape that contains the ink dies (FIG. 2, 202) may be flipped over and laid such that the ink dies (FIG. 2, 202) are sandwiched between the carrier substrate and the dicing tape. In this example, a thin-film surface of the ink dies (FIG. 2, 202) may be face-down on the carrier substrate.

In another example, the ink dies (FIG. 2, 202) may be placed (block 301) using a pick and place operation in which the ink dies (FIG. 2, 202) are mechanically picked and placed with a mechanical device. In yet another example, the ink dies (FIG. 2, 202) may be manually picked up and placed on the carrier substrate. In some examples, the ink dies (FIG. 2, 202) may be temporarily adhered to the carrier substrate via a double-sided adhesive tape.

The carrier substrate may be any material that provides mechanical rigidity to the ink dies (FIG. 2, 202). Examples of carrier substrates include metallic plates, printed circuit boards, or other mechanical substrate. In placing (block 301) the ink dies (FIG. 2, 202) on a carrier substrate, a thin film portion of the ink dies (FIG. 2, 202) may be placed face down on the carrier substrate.

The method (300) may include encapsulating (block 302) a number of surfaces of the ink die (FIG. 2, 202) with an overmold (FIG. 2, 203) having a second surface. As described above, the overmold (FIG. 2, 203) may be an epoxy molding compound (EMC) that is positioned on multiple exterior surfaces of the ink die (FIG. 2, 202). The encapsulation (block 302) may include pouring a liquid epoxy over the ink dies (FIG. 2, 202) to completely cover the ink dies (FIG. 2, 202) on the carrier substrate. The liquid epoxy may then be allowed to harden. In this example, the overmold (FIG. 2, 203) may encapsulate the exposed surfaces of the ink die (FIG. 2, 202) while being flush with a surface of the ink die (FIG. 2, 202) that is attached to the carrier substrate. More detail concerning the encapsulation (block 302) of the ink dies (FIG. 2, 202) with the overmold (FIG. 2, 203) is given below in connection with FIGS. 6A and 6B.

The method (300) may include forming (block 303) an ink slot (FIG. 2, 205) through the overmold (FIG. 2, 203) and the ink die (FIG. 2, 202). As described above, the ink slot (FIG. 2, 205) may allow ink to move from an ink reservoir (FIG. 2, 207) in the printhead (FIG. 1, 100) to an ejection device that includes a firing chamber, a resistor, and a nozzle among other ink ejection components.

As described above, in some examples, the ink slot (FIG. 2, 205) may be a partial ink slot (FIG. 2, 205). In this example, the ink slot may pass through the overmold (FIG. 2, 203) and extend into a portion of the ink die (FIG. 2, 202). In this example, the ink slot (FIG. 2, 205) may act as a channel directing from a first end of the ink slot (FIG. 2, 205) to a second end of the ink slot (FIG. 2, 205). The first end of the ink slot (FIG. 2, 205) may be proximate to the ink reservoir (FIG. 2, 207) and the second end may be proximate to the ink ejection device.

In another example, the ink slot (FIG. 2, 205) is a through ink slot (FIG. 2, 205). In this example, the ink slot (FIG. 2, 205) extends through the overmold (FIG. 2, 203) as well as the ink die (FIG. 2, 202). The ink ejection device may include a number of nozzles, for example in the form of an orifice plate.

In some examples, forming (block 303) an ink slot (FIG. 2, 205) includes forming an ink slot (FIG. 2, 205) pitch, such that ink may flow from one end of the ink slot (FIG. 2, 205) to another end of the ink slot (FIG. 2, 205).

In some examples, the method (300) includes removing the ink delivery device (FIG. 1, 101) from the carrier substrate. For example, a process may be carried out that removes the double-sided adhesive tape that joins the ink dies to the carrier substrate. The number of ink dies (FIG. 2, 202) may then be singulated for placement on a printhead (FIG. 1, 100).

Figure 4:
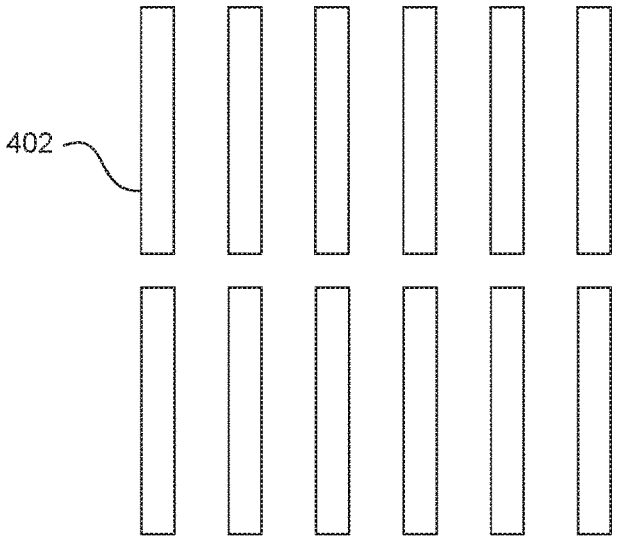
FIG. 4 is a diagram illustrating the formation of an overmolded ink delivery device according to one example of the principles described herein.

FIG. 4 is a diagram illustrating the formation of an overmolded ink delivery device (FIG. 1, 101) according to one example of the principles described herein. As described above, an overmolded ink delivery device (FIG. 1, 101) includes an ink die (402) having a first surface. The ink die (402) may be formed out of a substrate, such as for example, metal, silicon, or other substrate material. A number of ink dies (402) may be formed on a silicon substrate. In FIG. 4, for simplicity, one ink die (402) is indicated with a reference number; however, FIG. 4 depicts a number of ink dies (402) on a silicon substrate.

The individual ink dies (402) may be formed using a mechanical cutting operation. In another example, the individual ink dies (402) may be scored by a focused laser that creates microcracks in the form of the individual ink dies (402). The individual ink dies (402) may then be broken along the microcracks to be separated. In some examples, the individual ink dies (402) may be placed on a dice tape and the tape may be expanded to space the ink dies (402) as desired.

Figure 5:
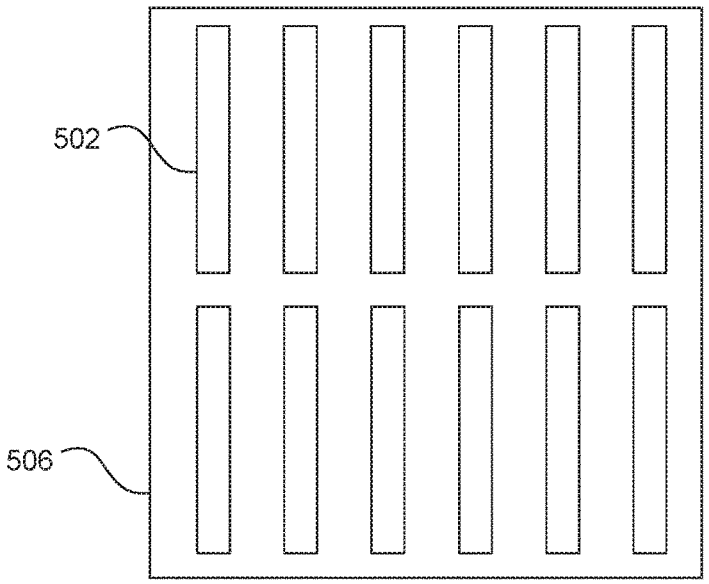
FIG. 5 is another diagram illustrating the formation of an overmolded ink delivery device according to one example of the principles described herein.

FIG. 5 is another diagram illustrating the formation of an overmolded ink delivery device (FIG. 1, 101) according to one example of the principles described herein. As described above, the number of ink dies (502) may be placed on a carrier substrate (506). The carrier substrate (506) may be any material that provides a mechanical rigidity to the number of ink dies (502) during formation. For example, the carrier substrate (506) may be a metallic plate. In another example, the carrier substrate (506) is a printed circuit board.

As described above, in some examples, the ink dies (502) may be placed on a tape, and the tape may be expanded to space and position the ink dies (502). In this example, the ink dies (502) on the tape are inverted and placed on the carrier substrate (506) such that a thin film surface of the ink dies (502) are face down on the carrier substrate. In this example, the ink dies (502) are disposed between the carrier substrate (506) and the tape. Once the ink dies (502) are adhered to the carrier substrate (506), the dice tape is removed in preparation for overmolding.

In another example, the ink dies (502) are mechanically placed on the carrier substrate (506) using a device such as a pick and place machine.

In other examples, the ink dies (502) are manually placed on the carrier substrate (506). In these examples, the ink dies (502) may be temporarily adhered to the carrier substrate (506) via a double-sided adhesive tape.

Figure 6A:
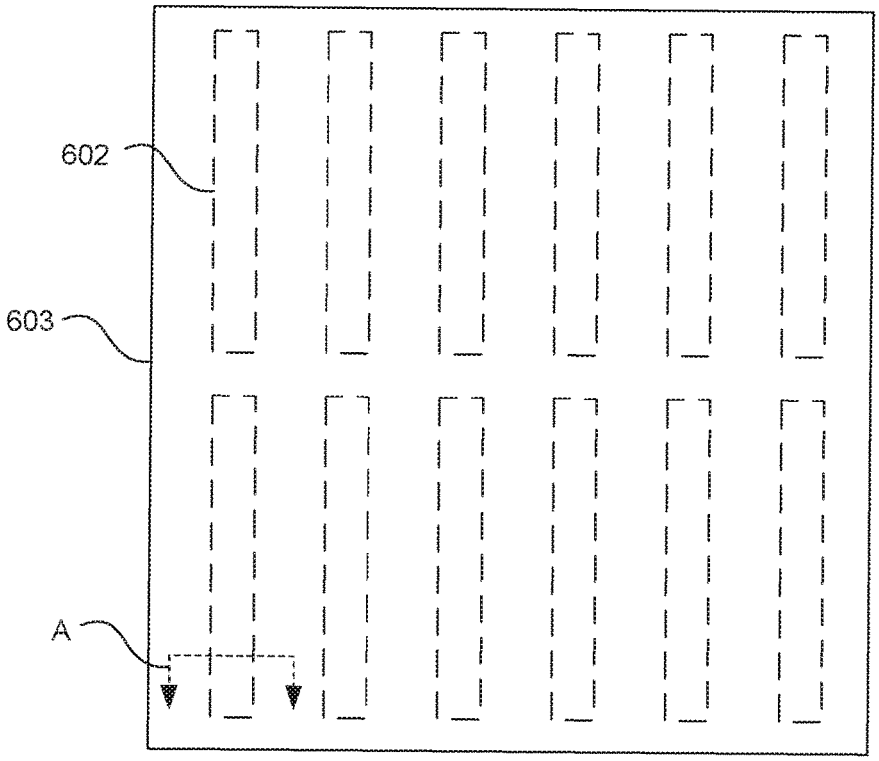
FIGS. 6A and 6B are diagrams illustrating the formation of an overmolded ink delivery device according to one example of the principles described herein.
Figure 6B:
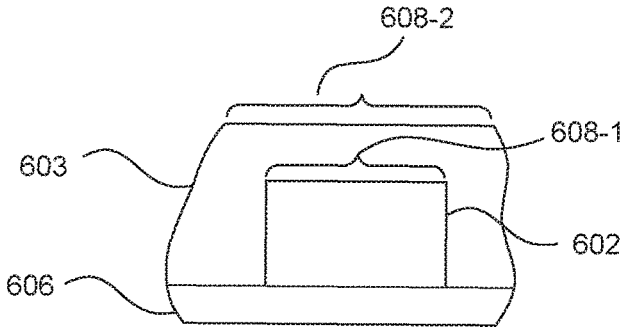

FIGS. 6A and 6B are diagrams illustrating the formation of an overmolded ink delivery device (FIG. 1, 101) according to one example of the principles described herein. As described above, the ink dies (602) may be encapsulated by an overmold (603). In some examples, this includes pouring a liquid epoxy molding compound on the ink dies (602). For example, as depicted in FIG. 6A, a liquid epoxy molding compound overmold (603) is poured such that it extends above the surface of the ink dies (602). The ink dies (602) in FIG. 6 are indicated as being below the level of the overmold (603) by the dashed line. The liquid epoxy overmold (603) may then be allowed to cure into a hard substance.

FIG. 6B is a cross-sectional view of one ink die (602) taken along the line "A" from FIG. 6A. As can be seen in FIG. 6B, the overmold (603) may be poured on top of the ink die (602) such that the overmold (603) may extend above a first surface (608-1) of the ink die (602). In this example, the overmold (603) may encapsulate multiple surfaces of the ink die (602). As described above, the ink die (602) may include a first surface (608-1) that is in contact with the overmold (603). The overmold (603) may include a second surface (608-2) that is used to attach the ink delivery device (FIG. 1, 101) to the printhead (FIG. 1, 100).

Figure 7A:
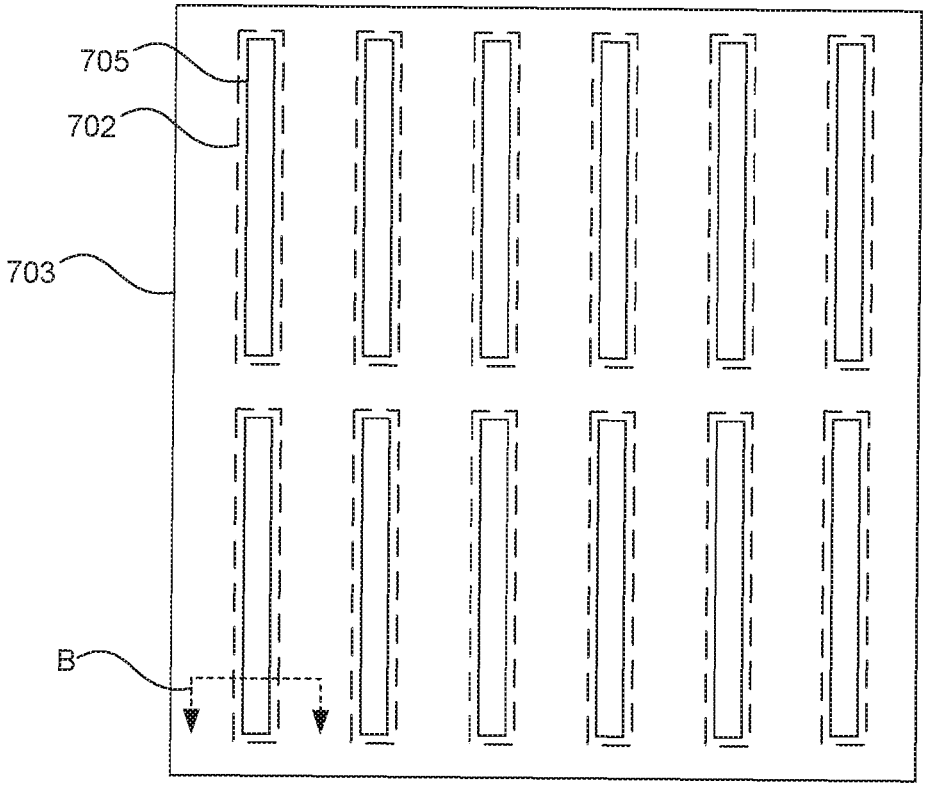
FIGS. 7A and 7B are diagrams illustrating the formation of an overmolded ink delivery device according to one example of the principles described herein.
Figure 7B:
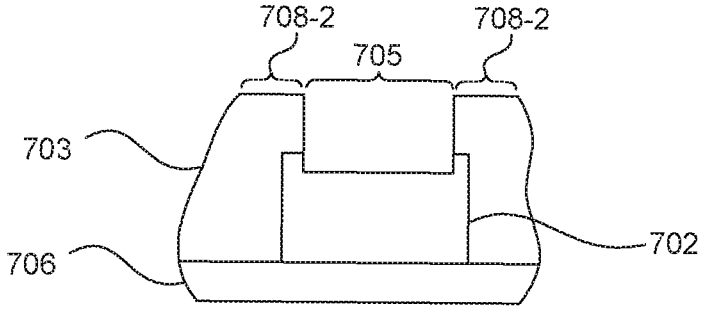

FIGS. 7A and 7B are diagrams illustrating the formation of an overmolded ink delivery device (FIG. 1, 101) according to one example of the principles described herein. As described above, an ink slot (705) may be cut through the overmold (703) and at least a portion of the ink die (702). The ink slot (705) allows ink to move from an ink reservoir (FIG. 2, 207) in the printhead (FIG. 1, 100) to an ink ejection device including a firing chamber, a resistor, and a nozzle, among other ink ejection components. In cutting the ink slot (705) a portion of the ink die (702) is exposed. In other words, in cutting the ink slot (705) a bottom surface of the ink slot (705) may be defined by the ink die (702) and the sidewalls of the ink slot (705) may be defined by the overmold (703).

Figure 10:
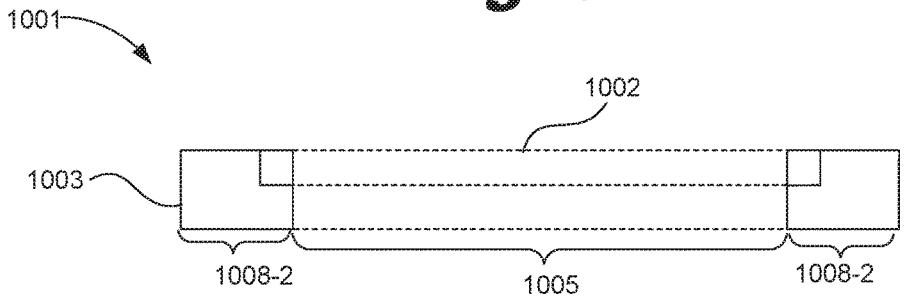
FIG. 10 is another cross sectional diagram of an overmolded ink delivery device according to one example of the principles described herein.

FIG. 7B is a cross-sectional view of one ink die (702) taken along the line "B" from FIG. 7A. As can be seen in FIG. 7B, the ink slot (705) may extend through the overmold (703) and into at least a portion of the ink die (702). For example, as depicted in FIG. 7B, the ink slot (705) extends partially into the ink die (702), to form a partial ink slot (705). In another example, as depicted in FIG. 10, the ink slot (705) extends through the overmold (703) and through the ink die (702) to create a through ink slot (705).

The overmold (703) may have a second surface (708-2) that may be used to attach the ink delivery device (FIG. 1,101) to the printhead (FIG. 1, 100). The second surface (708-2) is defined as the space between an edge of the ink die (702) and an edge of the overmold (703). In FIG. 7B, the second surface (708-2) may receive an adhesive (FIG. 2, 204) to attach the ink delivery device (FIG. 1, 101) to the printhead (FIG. 1, 100). The second surface (708-2) provides a larger contact area than the first surface (FIG. 2, 208-1). For example, a width of the second surface (708-2) is greater than a width of the first surface (FIG. 2, 208-1).

Using just the first surface (FIG. 2, 208-1) to attach the ink delivery device (FIG. 1, 101) to the printhead (FIG. 1, 100) may constrain the size of the ink die (702). However, using the second surface (708-2) to provide the contact area for attachment to the printhead (FIG. 1, 100) may be beneficial because the second surface (708-2) provides a larger contact area than the first surface (FIG. 2, 208-1) which allows the ink die (702) to be further reduced in size, while maintaining adhesion to the printhead (FIG. 1, 100).

As the ink slot (705) is cut, the overmold (703) encapsulates a number of surfaces of the ink die (702). For example, the overmold (703) may encapsulate a left surface and a right surface of the ink die (702) as well as a front surface and a back surface.

Figure 8:
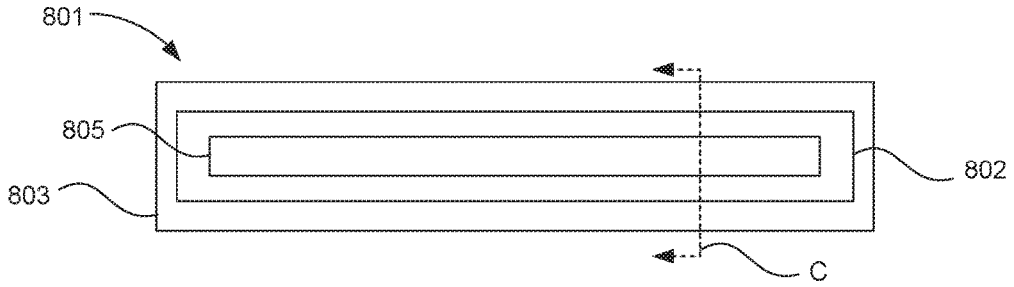
FIG. 8 is a top view of an overmolded ink delivery device according to one example of the principles described herein.

FIG. 8 is a top view of an overmolded ink delivery device (801) according to one example of the principles described herein. After the ink die (802) is slotted, the ink delivery device (801) may be removed from the carrier substrate (FIG. 7, 706), by for example, thermally altering the adhesive tape such that it no longer retains the ink delivery device (801) to the carrier substrate (FIG. 7, 706). Thus, as depicted in FIG. 8, the ink delivery device (801) includes an ink slot (805) that may be a partial ink slot or a through ink slot. The ink slot (805) may be pitched to allow ink to flow from an ink reservoir (FIG. 2, 207) to an ink ejection device. The ink slot (805) may be formed in an ink die (802) that is a substrate such as silicon. The ink die (802) may be encapsulated at least in part, by an overmold (803) formed of a material such as an epoxy molding compound.

Figure 9:
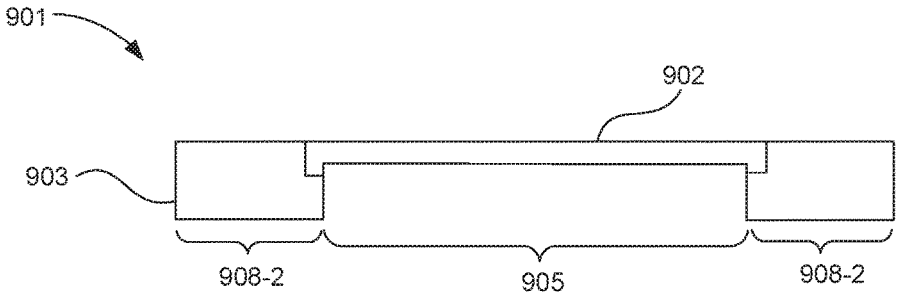
FIG. 9 is a cross sectional diagram of an overmolded ink delivery device according to one example of the principles described herein.

FIG. 9 is a cross sectional diagram of an ink delivery device (901) according to one example of the principles described herein. For simplicity, FIG. 9 is not drawn to scale. Rather, FIG. 9 is included to demonstrate the functions of the relative surfaces and is not intended to indicate specific size relations between different elements.

The diagram of FIG. 9 is taken along line "C" from FIG. 8. As described above, in some examples, the ink slot (905) is a partial ink slot. In other words, the ink slot (905) may extend through the overmold (903) and may extend into a portion of the ink die (902). One surface of the ink slot (905) may be formed by the ink die (902) and the side surfaces of the ink slot (905) may be formed by the overmold (903).

As indicated above, the overmold (903) contains a second surface (908-2) that is used to attach the ink delivery device (901) to the printhead (FIG. 1, 100) and that is wider than a first surface (FIG. 2, 208-1). Via an adhesive (FIG. 2, 204) applied to the second surface (908-2) the ink delivery device (901) is attached to the printhead (FIG. 1, 100). The contact area provided by the second surface (908-2) is larger than the contact area available from the first surface (FIG. 2, 208-1). In other words, the second surface (908-2) may be sized such that the ink die (902) may be reduced in size while maintaining adhesion to the printhead (FIG. 1, 100) via the adhesive placed on the second surface (908-2).

FIG. 10 is a cross sectional diagram of an ink delivery device (1001) according to one example of the principles described herein. The diagram of FIG. 10 is taken along line "C" from FIG. 8. As described above, in some examples, the ink slot (1005) may be a through ink slot. In other words, the ink slot (1005) may extend through the overmold (1003) and may extend through the ink die (1002). In FIG. 10, the dashed lines may represent a distal portion of the ink delivery device (1001).

As indicated above, the overmold (1003) contains a second surface (1008-2) that is used to attach the ink delivery device (1001) to the printhead (FIG. 1, 100) and that is wider than the first surface (FIG. 2, 208-1). Via an adhesive (FIG. 2, 204) applied to the second surface (1008-2) the ink delivery device (1001) is attached to the printhead (FIG. 1, 100). The contact area provided by the second surface (1008-2) is larger than the contact area available from the first surface (FIG. 2, 208-1). In other words, the second surface (1008-2) is be sized such that the ink die (1002) may be reduced in size while maintaining adhesion to the printhead (FIG. 1, 00) via the adhesive placed on the second surface (1008-2).

Aspects of the present system and method are described herein with reference to flowchart illustrations and/or block diagrams of methods, apparatus (systems) according to examples of the principles described herein.

A device and method for forming an overmolded ink delivery device (FIG. 1, 101) may have a number of advantages, including: (1) allowing for smaller ink dies (FIG. 1, 102) regardless of a contact surface area used for attaching the ink die (FIG. 1, 102) to a printhead (FIG. 1, 100); (2) decoupling ink die (FIG. 1, 102) size from ink delivery device (FIG. 1,101) attachment; (3) providing additional structural rigidity in the form of the overmold (FIG. 2, 203); (4) freeing up space on the printhead (FIG. 1, 100); (5) reducing ink die (FIG. 2, 202) size without increasing printhead (FIG. 1, 100) cost; and (6) being backwards compatible with other printheads.

The preceding description has been presented to illustrate and describe examples of the principles described. This description is not intended to be exhaustive or to limit these principles to any precise form disclosed. Many modifications and variations are possible in light of the above teaching.

What is claimed is:

1. An ink delivery device comprising:

an ink die comprising:

a first surface to contact an overmold; and a groove which forms part of an ink slot; and the overmold to encapsulate a number of surfaces of the ink die, the overmold comprising:

a second surface to receive an adhesive to attach the ink delivery device to a printhead, which second surface is wider than the first surface; and a groove which forms part of the ink slot;

wherein a surface of the overmold is flush with a surface of the ink die.

2. The ink delivery device of claim 1, wherein the first surface is a bottom surface of the ink die.

3. The ink delivery device of claim 1, wherein the overmold provides an exclusive point of contact between the ink delivery device and the printhead.

4. The ink delivery device of claim 1, wherein the first surface and the second surface are parallel to one another.

5. The ink delivery device of claim 1, wherein sidewalls of the ink slot are defined by the overmold.

6. The ink delivery device of claim 1, wherein the overmold encapsulates a back surface of the ink die.

7. The ink delivery device of claim 1, wherein the ink slot is pitched from one end to the other.

8. The ink delivery device of claim 1, wherein the overmold is formed of an epoxy molding compound.

9. The ink delivery device of claim 1, wherein the overmold includes a filler material.

10. The ink delivery device of claim 9, wherein the filler material is selected from the group consisting of silica powder, alumina, silicon nitride, manganese oxide, calcium carbonate, and titanium white.

11. An ink delivery system comprising:

a printhead comprising an ink reservoir;

a plurality of ink delivery devices, in which each ink delivery device comprises:

an ink die comprising a first surface to contact an overmold;

the overmold to encapsulate a number of surfaces of the ink die, the overmold comprising a second surface to receive an adhesive to attach the ink delivery device to a printhead, which second surface provides a larger contact area than the first surface;

an ink slot cut through the ink die and the overmold; and an adhesive disposed between the printhead and the second surface to attach the ink delivery devices to the printhead, the adhesive being an expandable adhesive strip that is expanded to space multiple ink dies of the ink delivery devices.

12. The ink delivery system of claim 11, wherein the first surface is removed from a surface of the printhead.

13. The ink delivery system of claim 11, wherein the adhesive is same shape as the overmold.

14. The ink delivery system of claim 11, wherein a size of the ink die is decoupled from a size of the adhesive.

15. A method of manufacturing an ink delivery device, the method comprising:

placing an ink die with a first surface on a carrier substrate;

encapsulating a number of surfaces of the ink die with an overmold having a second surface; in which:

the second surface is used to attach the ink delivery device to a printhead; and the second surface is wider than the first surface; and forming, in the overmold and the ink die an ink slot through which ink passes;

wherein encapsulating a number of surfaces of the ink die with an overmold having a second surface comprises:

pouring a liquid epoxy over the ink die and carrier substrate; and hardening the liquid epoxy.

16. The method of claim 15, further comprising singulating an ink die from a sheet of silicon substrate.

17. The method of claim 15, further comprising placing the ink die on an expandable adhesive strip.

18. The method of claim 17, further comprising expanding the expandable adhesive strip to space multiple ink dies.

* * * * *